US006781114B1

(12) United States Patent
Grenier

(10) Patent No.: US 6,781,114 B1
(45) Date of Patent: Aug. 24, 2004

(54) RADIOGRAPHIC CAMERA

(75) Inventor: Steven J. Grenier, Arlington, MA (US)

(73) Assignee: AEA Technology QSA Inc., Burlington, MA (US)

( * ) Notice: Subject to any disclaimer, the term of this patent is extended or adjusted under 35 U.S.C. 154(b) by 62 days.

(21) Appl. No.: 09/687,554

(22) Filed: Oct. 13, 2000

(51) Int. Cl.[7] ..... G21F 8/02

(52) U.S. Cl. ..... 250/250; 250/497.1; 250/496.1; 250/337.1; 378/52

(58) Field of Search ..... 250/250, 497.1, 250/496.1, 337.1, 498.1, 506.1, 359.1, 498; 378/52; 74/502.4, 502.6, 580.5, 527; 600/1, 3, 6, 7; 414/146

(56) References Cited

U.S. PATENT DOCUMENTS

| | | | | |
|---|---|---|---|---|
| 3,393,317 A | | 7/1968 | Spencer | |
| 3,939,355 A | * | 2/1976 | Rosauer | 250/497.1 |
| 4,314,157 A | * | 2/1982 | Gaines | 250/497.1 |
| 4,692,628 A | * | 9/1987 | Sauerwein et al. | 250/497.1 |
| 4,827,493 A | | 5/1989 | Parsons et al. | 378/119 |
| 4,943,731 A | * | 7/1990 | Brown | 250/497.1 |
| 5,065,033 A | | 11/1991 | Parsons | 250/497.1 |
| 5,272,349 A | * | 12/1993 | Perry, III | 250/497.1 |
| 5,418,379 A | | 5/1995 | Parsons et al. | 250/497.1 |

FOREIGN PATENT DOCUMENTS

| | | |
|---|---|---|
| EP | 0 652 570 A1 | 5/1995 |
| EP | 0 654 684 A3 | 5/1995 |
| EP | 0 654 684 A2 | 5/1995 |
| JP | 08128206 | 12/1997 |
| JP | 09357315 | 7/1999 |

OTHER PUBLICATIONS

Operating and Maintenance Instructions for SENTINEL™, Gamma Radiography Products: Model 460 Gamma Ray Projector, Dec. 1994, pp. 1–29, Amersham International, 1994.

* cited by examiner

*Primary Examiner*—John R. Lee
*Assistant Examiner*—Zia R. Hashmi
(74) *Attorney, Agent, or Firm*—Wolf, Greenfield & Sacks, P.C.

(57) ABSTRACT

A radiographic camera has a housing, having first and second ends, that encloses a conduit having a radiographic source. The conduit is in communication with a lock assembly at the back end of the camera and to a connector assembly at the front end of the camera. The radiographic camera can be held within a jacket that has a handle with a reinforcement structure. The conduit is surrounded by a radiation shield that has a shield end attached to an endplate having a port outlet. The connector assembly features a front plate having a hole aligned with the port outlet on the endplate. The front plate features an internal surface to which a rotor is rotatably attached. The rotor provides a first rotor hole that is aligned with the port outlet and includes a port shield for blocking the first rotor hole, and a second rotor hole that is alignable with the port outlet. The rotor may be rotated so that either the first or second rotor hole is aligned with the port outlet to shield or expose the source.

22 Claims, 15 Drawing Sheets

RADIOGRAPHIC CAMERA

FIELD OF THE INVENTION

This invention relates to radiographic cameras. More particularly, this invention relates to a jacket for radiographic cameras, a connection between a radiation source shield to a housing of a radiographic camera, and a connector assembly for a radiographic camera.

BACKGROUND OF THE INVENTION

An X-ray machine can be used to make photographic images that indicate the internal composition of objects. One well known use is the detection of broken or fractured bones. A typical X-ray machine is inadequate for some tasks because it is unable to make photographic images of the interior structure of metals. Since a typical X-ray machine is large and requires a power source, it cannot be used in remote locations without significant expense.

Radiographic cameras are used to make images similar to X-ray images, but are used with greater flexibility. A radiographic camera can record images of the interior structure of metals that cannot be imaged with an X-ray machine. In addition, these cameras are portable and operate without an external power source. Therefore they are useful in taking images of objects in their natural environment. Radiographic cameras are used extensively in the oil industry, for example, to check for flaws in metal pipelines that could otherwise cause oil spills.

A typical radiographic camera and source are described in U.S. Pat. Nos. 5,065,033 and 4,827,493, respectively. Each of these patents is assigned to the same assignee as the present invention, and each is hereby incorporated by reference in their entirety. As shown in FIG. 1 of U.S. Pat. No. 5,065,033, an S-shaped tubing extends from a back end of the camera to a front end. The tubing is surrounded by a radiation shield and encloses a radiographic source at the end of a source cable. Typically, the S-shaped shaped tube attaches the radiation shield to a housing at the back and front ends of the camera. A typical radiographic source includes stacked iridium-192 wafers that are contained inside a welded capsule. Since the radiographic source emits radiation in a line, when the source is in a stored position (as in FIG. 1), only minimal radiation is reflected toward the front end, by which time any radiation that remains is significantly decreased.

A lock assembly is provided over an opening at the back end of the camera, and a threaded nut blocks an opening at the front end. Control cables are attached to the back end, and a guide cable is screwed to the front end. The lock assembly in the back prevents the radiation source from being pushed out of the front end without first using a key to unlock the camera, and then connecting a control cable. At the front end of a typical camera, a technician removes the threaded nut, and attaches a guide cable with a threaded end over the threaded mount on the housing. When the control cables and guide cable are positioned, the technician operates a hand crank to move a wire in the control cable, which pushes the source out of the camera housing, and to the end of the guide cable. The end of the guide cable is then positioned on one side of an object that is to be imaged, and photographic cassettes are placed on the other side. The technician sets the exposure time. When finished, the technician reverses the direction of the crank to retract the source.

U.S. Pat. No. 5,418,379, assigned to the same assignee as the present invention and hereby incorporated by reference in its entirety, discloses a connector assembly. As shown in FIG. 3, a plug assembly blocks the front opening when in a stored position. The plug cannot be completely removed from the connector assembly until a shield is first moved to block the opening by operating a manually actuable slide. An interlock mechanism is also disclosed that is provided between the lock assembly at the back of the camera and the connector assembly so that the lock assembly cannot be actuated to receive the control cables until the guide cable is coupled to the front end. Thus, either the guide cable or plug assembly must be on the connector assembly in order for the lock assembly to be accessed.

SUMMARY OF THE INVENTION

According to the present invention, a radiographic camera is disclosed having certain improvements. In one illustrative embodiment of the invention, a jacket for the radiographic camera includes a front end, a back end opposite the front end and a handle positioned between the ends, where the handle includes a reinforcement structure. The reinforcement structure may include a wire and an additional protective element, such as a tube. In an illustrative embodiment, the jacket has an opening for receiving a radiographic camera that extends through the front end of the jacket to the back end of the jacket. The wire surrounds the opening at the front end, extends through the handle and surrounds the opening at the back end of the camera. Ferrules may be provided to secure the ends of the wire in the handle. The jacket may be made of molded polyurethane and the wire and the tubing may be stainless steel. Additionally, the jacket may be removably secured to the radiographic camera so that it may be removed from the camera, if desired.

In another illustrative embodiment of the invention, a radiographic camera includes a housing having a source surrounded by a shield assembly, where the shield has first and second shield ends and an endplate having a first surface secured to the first shield end. A bracket may be provided on the first surface of the endplate and secured to the first shield end. For example, a pin may be used to removably secure the shield end to the bracket. The second shield end may also be secured to a second bracket on a second endplate with a second pin. The pin may be solid titanium, the shield may be depleted uranium, and the endplate and bracket may be stainless steel. A spacer made of copper may be provided between each shield end and bracket. Additionally, a port outlet may be formed through the endplates and brackets to receive a conduit for the source.

In another illustrative embodiment of the invention, a connector assembly is provided for a radiographic camera which has a housing containing a source in a pathway surrounded by a radiation shield. A first end of the housing includes a first opening in communication with the pathway. A shield protector is adapted to block and unblock the first opening. The shield protector is provided between the first endplate and a front plate. The front plate includes a second opening aligned with the first opening and adapted to receive a cable guide fitting that allows the shield protector to unblock the first opening and expose the source.

The shield protector may be a rotor rotatably attached an interior surface of the front plate between the front plate and the first endplate. The rotor may have a first rotor hole for locating a port shield to be aligned with the first opening rotor. The rotor may also have a second rotor hole adapted to be aligned with the first opening when the rotor is rotated.

A slider may be provided adjacent the rotor. The slider prevents the rotor from rotating. The second opening may be adapted to receive the guide cable fitting to move the slider to allow the rotor to rotate and expose the first opening through the second rotor hole.

A knob may be provided rotatably attached to an exterior surface of the front plate and positioned to cover and uncover the second opening. The knob is rotatable to expose the second opening such that the guide cable fitting may be inserted within the second opening to move the slider. Thus, the knob may further rotate to align the second rotor hole within the first opening and the second opening to expose the source.

In another illustrative embodiment of the invention, a connector assembly includes a connection element, a shield protector and a lock. The connection element is adapted to engage with a guide cable. The connection element has an opening aligned with a radiation source opening in the camera through which a radiation source can pass. The shield protector may be moved between blocking and unblocking positions. The blocking position has the shield protector blocking the radiation source opening. The unblocking position has the shield protector not blocking the radiation source opening. The lock is adapted to lock the shield protector in the blocking position and is adapted to unlock the shield protector upon activating a key that allows the shield protector to move to the unblocking position. The shield protector may include a rotor to block and unblock the radiation source opening. The lock may include a slider that is adapted to engage with a key to unlock the rotor from the blocking position. The connector assembly may also include a knob adapted to move the rotor to unblock the radiation source opening upon engagement of the slider with the key. The lock may also be adapted to engage with a guide cable fitting that acts as a key. The lock may include a slider that unlocks the shield protector from the blocking position when the guide cable fitting is secured to the opening in the connection element.

In another illustrative embodiment of the invention, a method of operating a radiation camera is provided. The method includes the step of unlocking a shield protector that blocks a radiation source opening of the camera. Further, steps include moving the shield protector to unblock the radiation source opening and moving a radiation source from within the camera through the radiation source opening. The step of unlocking the shield protector may include attaching a guide cable fitting to the camera. The step of unlocking the shield protector may include engaging the guide cable fitting with a slider. The step of moving the shield protector may include rotating a knob attached to the shield protector to align a hole on the shield protector with the radiation source opening.

BRIEF DESCRIPTION OF THE DRAWINGS

Other features and advantages of the invention will become apparent from the following detailed description taken in conjunction with the accompanying drawings, in which.

DETAILED DESCRIPTION

Figure 1:
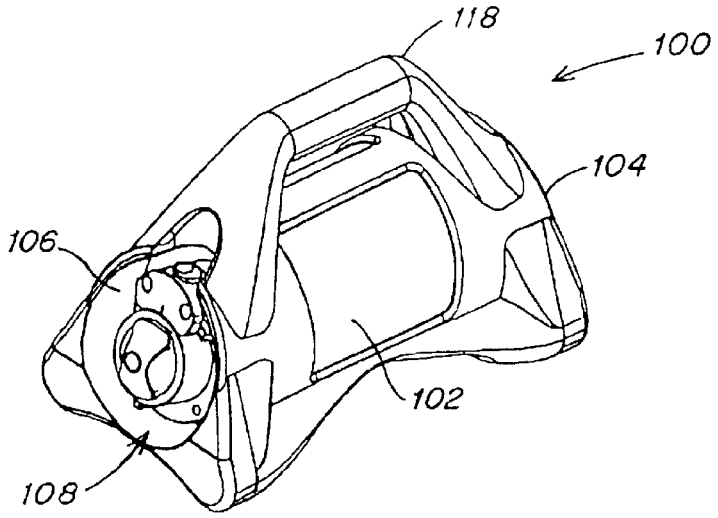
FIG. 1 is a perspective view of a radiographic camera including a jacket according to an embodiment of the invention.

The present invention relates to radiographic cameras. More specifically, the present invention relates to a jacket, an attachment for a radiation shield, and a connector assembly, all for a radiographic camera. A radiographic camera 100, according to the illustrated embodiment as shown in FIGS. 1–5, has a housing 102 with openings at a front end 104 and a back end 106 where a guide cable (not shown) and control cables (not shown), respectively, may be coupled. The housing 102 has a cylindrical shape (see FIGS. 3–5) forming a cylindrical tube; however, the housing could be any shape so long as it could contain suitable camera components. A lock assembly 108 is provided at the opening in the back end 106. A connector assembly 110 is provided at the opening in the front end 104. A radiation source 112 is mounted at the end of a source cable 114, which is in a conduit 116. As shown, the conduit 116 is S-shaped, although the conduit 116 could be made in any suitable shape. The conduit 116 is enclosed inside the housing 102 and is in communication with the lock assembly 108 and the connector assembly 110. The source 112 is inside the housing 102 when the camera 100 is in a stored condition.

When the camera 100 is to be used, the control cables and guide cable are attached to the lock assembly 108 and the connector assembly 110, respectively. The control cable has a wire (not shown) which pushes the source 112 from the camera oil l housing 102 into the guide cable, e.g., when a technician operates a crank at the end of the control cables. The source 112 is pushed until it reaches the end of the guide cable. The end of the guide cable is placed suitably near an object with photographic film cassettes (not shown) positioned on the other side of the object. After an exposure time has lapsed, the source 112 is withdrawn from the guide cable into the conduit 116 in the housing 102.

Figure 2:
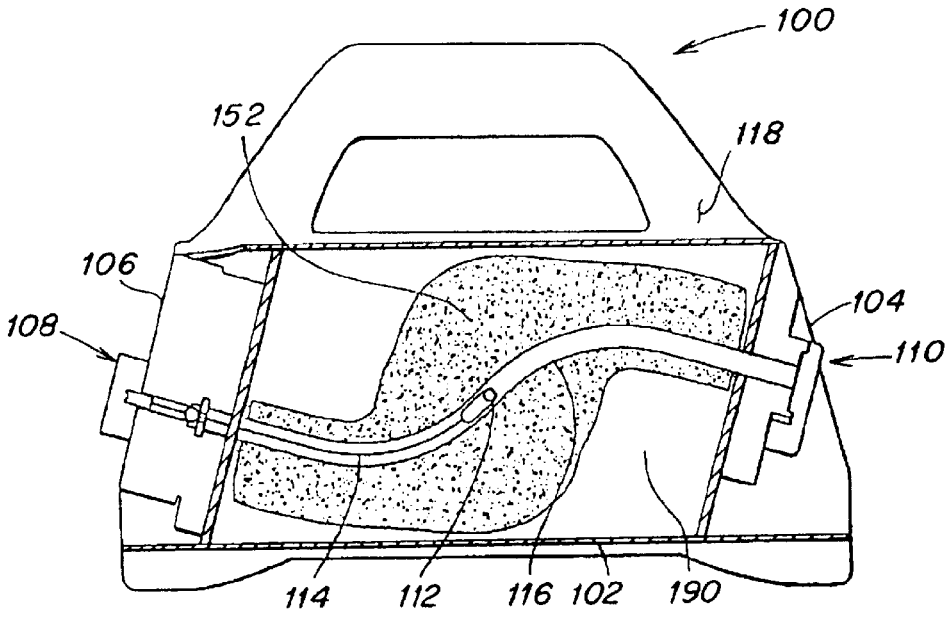
FIG. 2 is a side view of the radiographic camera of FIG. 1, and shows the inside of the camera.
Figure 3:
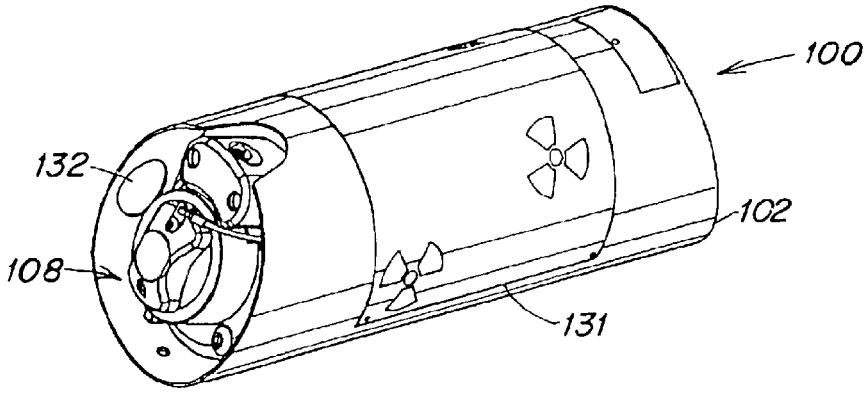
FIG. 3 is a perspective view of the radiographic camera of FIG. 1 without the jacket.
Figure 4:
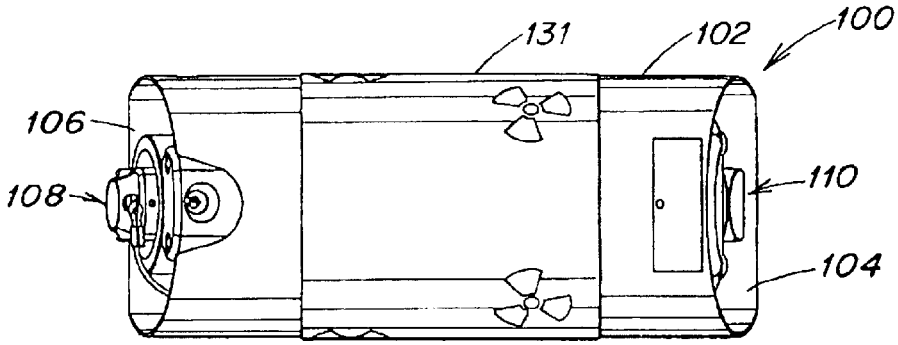
FIG. 4 is a top view of the radiographic camera of FIG. 3.
Figure 5:
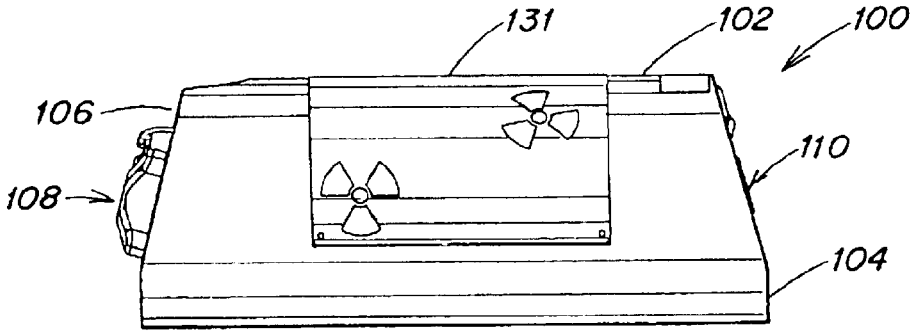
FIG. 5 is a side view of the radiographic camera of FIG. 4.

A jacket 118 may be provided with the radiographic camera 100 as shown in FIGS. 1 and 2. The jacket 118 may provide for easy transportation of the radiographic camera 100, and a protective cover for the radiographic camera 100. Radiographic cameras 100 can weigh over thirty pounds, thus it can be advantageous to have a jacket 118 to allow for easy carrying of the device. The jacket 118 may be removable from the housing 102 of the radiographic camera 100, such that the camera 100 can be used without the jacket 118 if the camera 100 needs to be placed within a more confined area that will not accommodate the jacket 118 or if the camera 100 is to be used with another device such as a remote controlled device. The housing 102 may be slid within the jacket 118 and the jacket 118 removably secured to the housing 102 using rivets or screws (not shown). The jacket 118 is made of molded polyurethane, although the jacket 118 could be made of any suitable material or combination of materials including plastics and metals.

Figure 6:
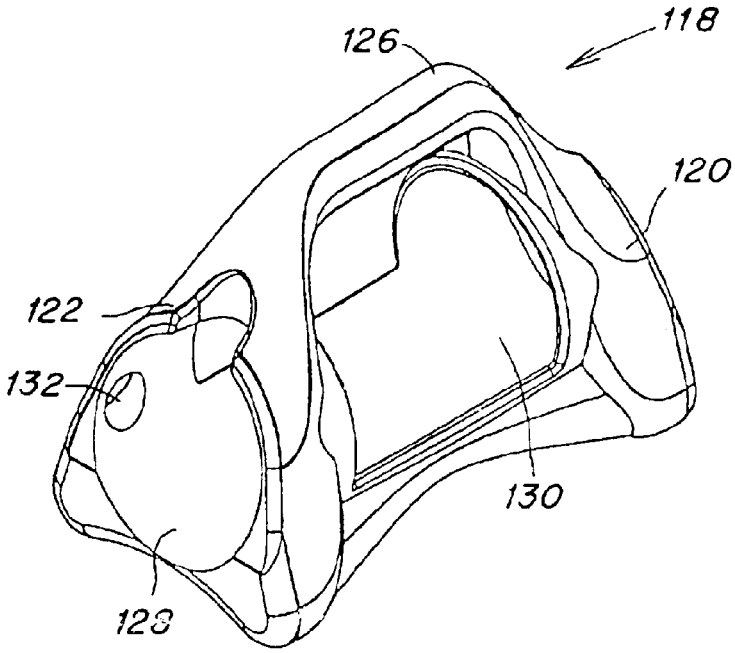
FIG. 6 is a perspective view of the jacket for a radiographic camera according to another embodiment of the invention.
Figure 7:
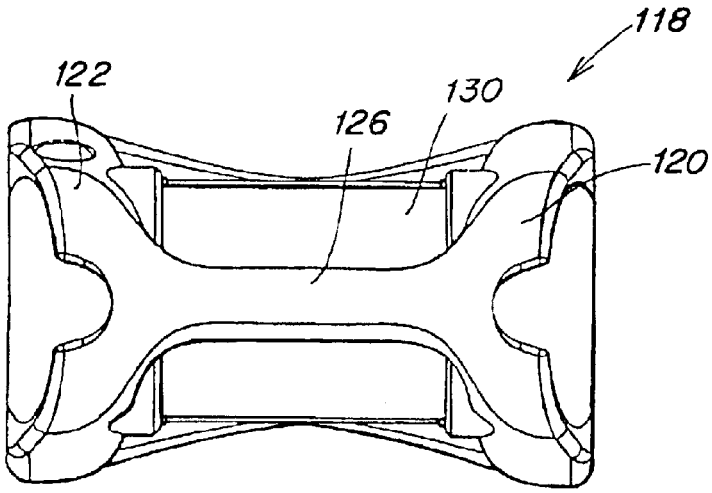
FIG. 7 is a top view of the jacket of FIG. 6.
Figure 8:
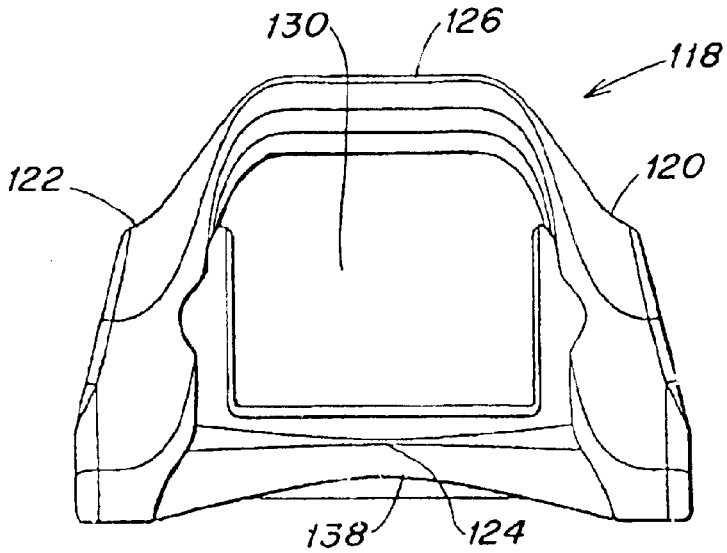
FIG. 8 is a side view of the jacket of FIG. 6.
Figure 9:
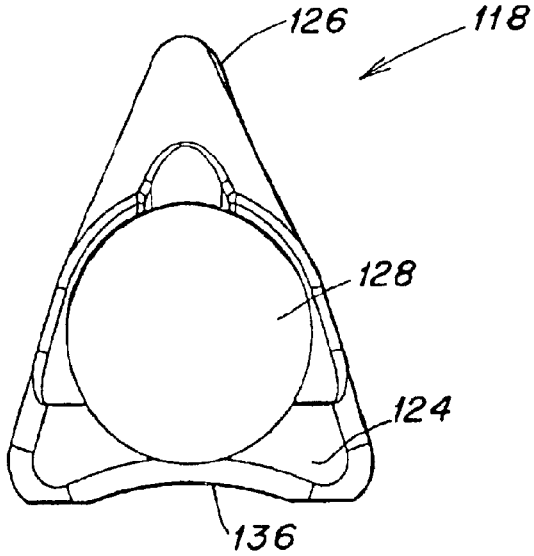
FIG. 9 is a front view of the jacket of FIG. 6.
Figure 10:
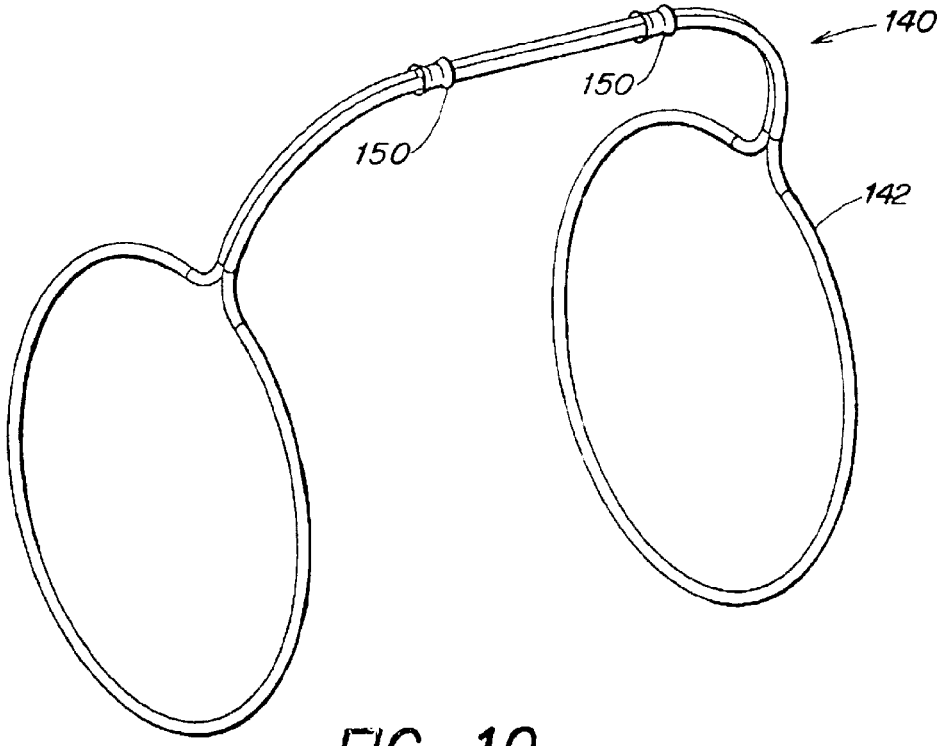
FIG. 10 is a perspective view of the reinforcement wire contained in the jacket according to an embodiment of the invention.
Figure 19:
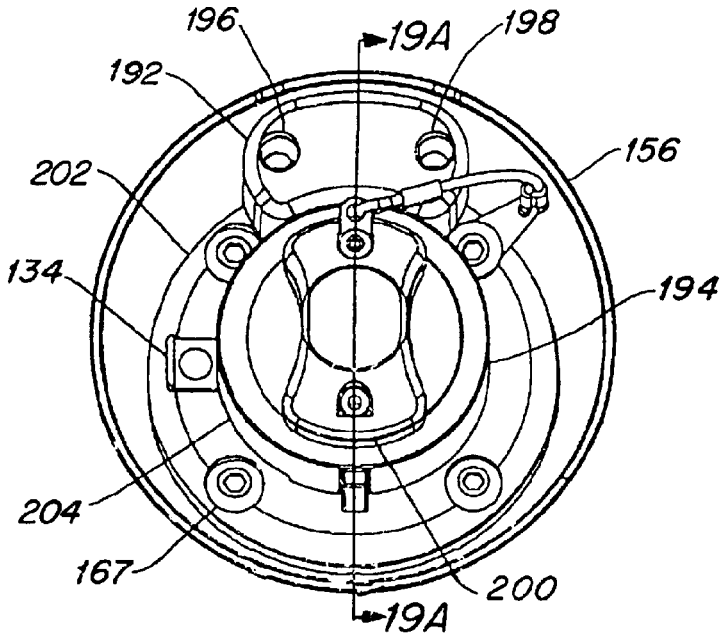
FIG. 19 is a front view of the lock assembly according to an embodiment of the invention.

Referring to FIGS. 6–9, another embodiment of the jacket 118 features a first end 120, a second end 122 opposite the first end 120 forming a body 124 of the jacket 118 and a handle 126 positioned between the ends 120 and 122. An opening 128 is formed by the jacket 118 from the first end 120 through the second end 122 to accommodate the radiographic camera 100. It will be understood that the first and second ends 120 and 122 of the jacket 118 may not be connected except at the handle 126. As shown, in the illustrated embodiment of the invention, the opening 128 is cylindrical to accommodate the cylindrical housing 102 of the camera 100, and the handle 126 is located above the body 124 of the jacket 118 connecting the first and second ends 120 and 122. The opening 128 can be any desired shape to accommodate any shaped housing 102, such as a square or rectangular shape. The handle 126 can be provided anywhere on the body 124, and may be any convenient shape for transporting the camera 100. FIGS. 1 and 6–9 show a partial opening 130 defined between the first and second ends 120 and 122 to expose part of the housing 102 for the camera 100. Source identification labels 131 may be included on the housing 102 to show through this partial opening 130 (see FIGS. 3–5). Additionally, a hole 132 may be formed in one end of the jacket 118, as shown in FIG. 6, for accommodating a finger to activate a lock slide 134 (see FIG. 19) on the lock assembly 108. In the illustrated embodiment, as shown in FIG. 9, first and second ends 120 and 122 of the jacket 118, when viewed from the front and back views, may have a first rounded bottom portion 136 or other suitable shape such that the jacket 118 may be set on a pipe having similar radius. Additionally, referring to FIG. 8, from the side views, the jacket 118 may have a second rounded bottom portion 138 or other suitable shape to accommodate pipes having a similar radius. Thus, there may be at least two different orientations for stably locating the jacket 118 on top of different sized pipes.

Figure 11:
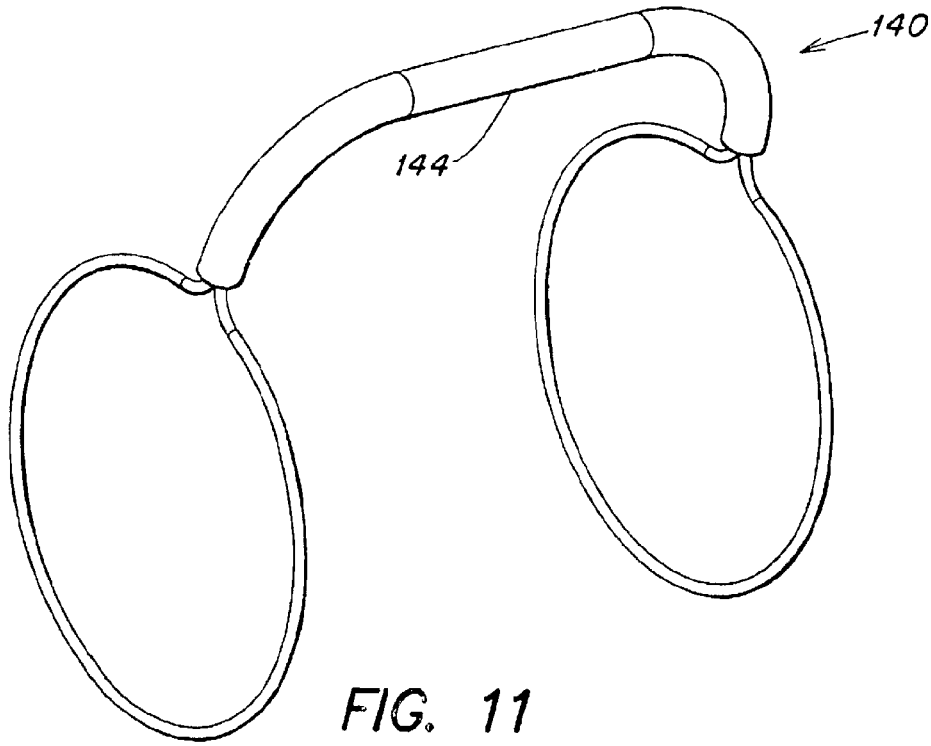
FIG. 11 is a perspective view of the wire of FIG. 10 covered by tubing.
Figure 12:
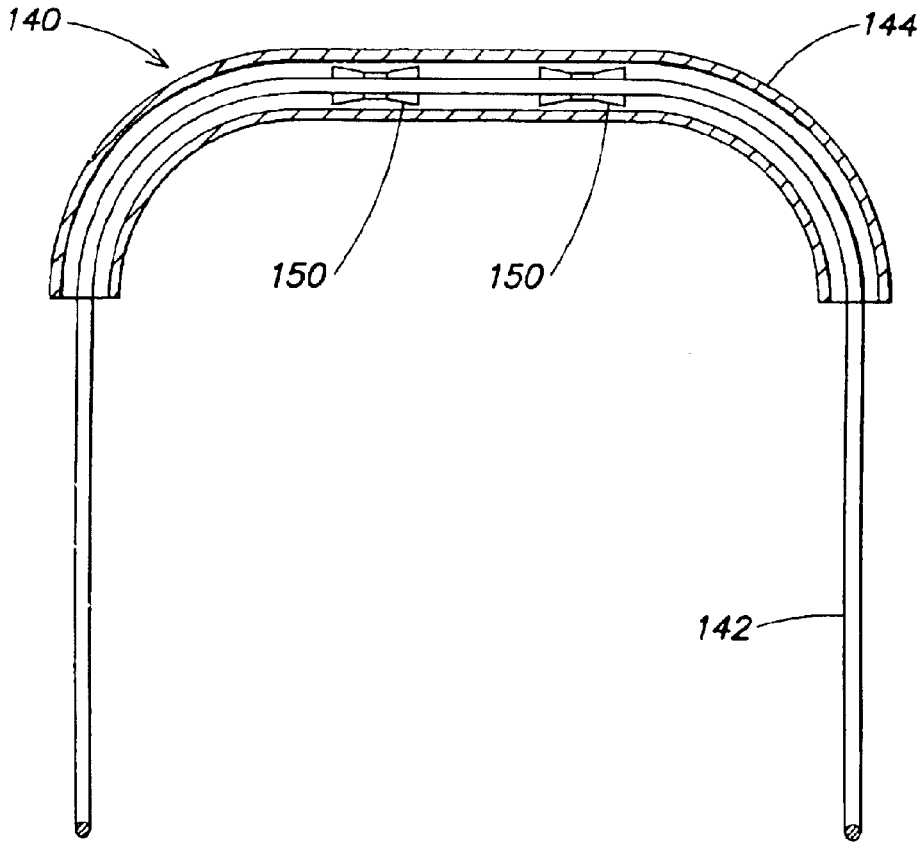
FIG. 12 is a side view of the wire, tubing and ferrules of FIG. 11.
Figure 13:
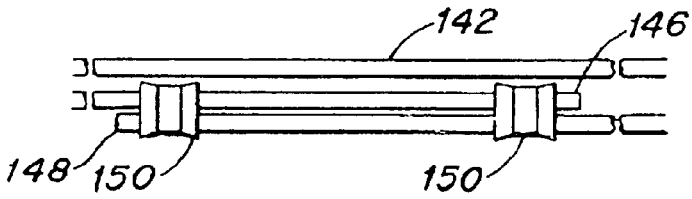
FIG. 13 is a detailed view of the wires and ferrules of FIG. 12 contained in the handle of the jacket.

Because the camera 100 may be heavy, a reinforcement structure 140 may be included in the handle 126 of the jacket 118 to support the handle 126, e.g., provide additional strength to the handle 126 and/or provide a safety feature such that if other portions of the handle 126 break, the reinforcement structure 140 may prevent complete failure of the handle 126. For example, if a molded polyurethane portion of the handle 126 breaks while the camera 100 is being carried, the reinforcement structure 140 may provide a back-up support, thus preventing the person carrying the camera 100 from dropping the camera 100. The reinforcement structure 140 may include a wire 142, and an additional protective element 144, such as tubing. As shown in FIGS. 10–13, in the illustrated embodiment of the invention, the wire 142 surrounds the opening at the first end 120 of the jacket 118, extends through the handle 126 and surrounds the opening at the second end 122 of the jacket 118. The wire 142 may provide additional support from under the housing 102. Referring to FIGS. 11, 12 and 13, tubing 144 surrounds the wire 142 contained within the handle 126. The tubing 144 may provide additional strength to the handle 126 and/or provide a larger surface area for the wire, e.g., to prevent the wire 142 from cutting through the jacket 118 or to more comfortably allow a person to carry the weight of the camera 100. The wire 142 may be a continuous loop, or the wire may have two ends 146 and 148. Preferably, the wire 142 is oriented in such a manner that the ends 146 and 148 of the wire 142 are located within the handle 126. Further, as shown in FIG. 13, ferrules 150 may be used to secure the ends 146 and 148 of the wire 142. In the illustrated embodiment, the wire 142 is ⅛ inch preformed stainless steel aircraft cable of 7×19 construction, the tubing 144 is stainless steel, and the ferrules 150 are copper plated; although wire 142, tubing 144 or ferrules 150 of any construction or material may be used. For example, the reinforcement structure 140 may include a single cast or otherwise formed structure of any suitable material that includes two loops to support either end of the camera 100 and a portion between the loops to act as a handle or support for a handle. It will be understood that the handle 126 may be formed only of the reinforcement structure 140, such as wire 142 and/or tubing 144 without any molded plastic or other structure provided over the wire 142 or tubing 144.

Figure 14:
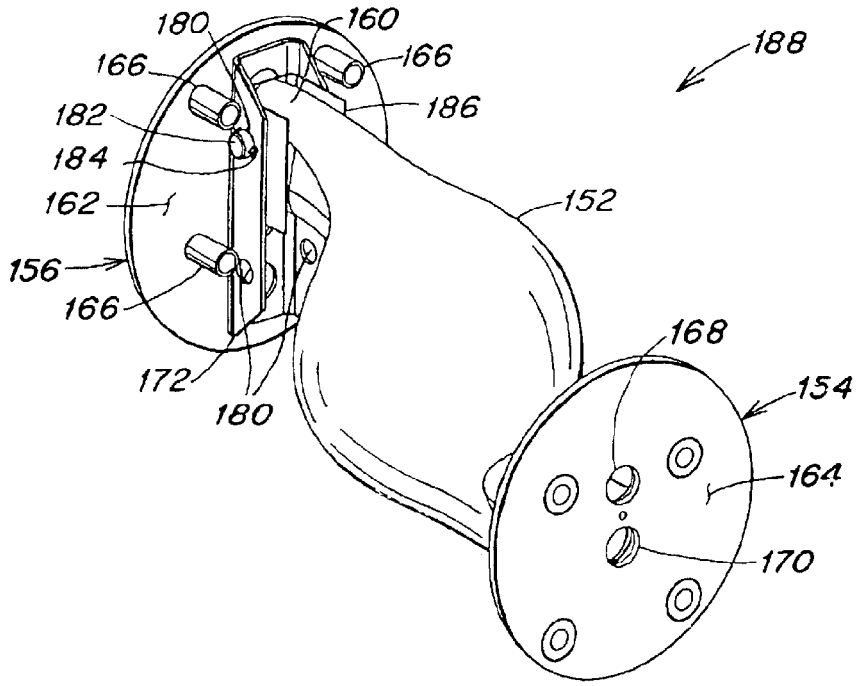
FIG. 14 is a perspective view of the depleted uranium shield and endplates of the radiographic camera according to an embodiment of the invention.
Figure 15:
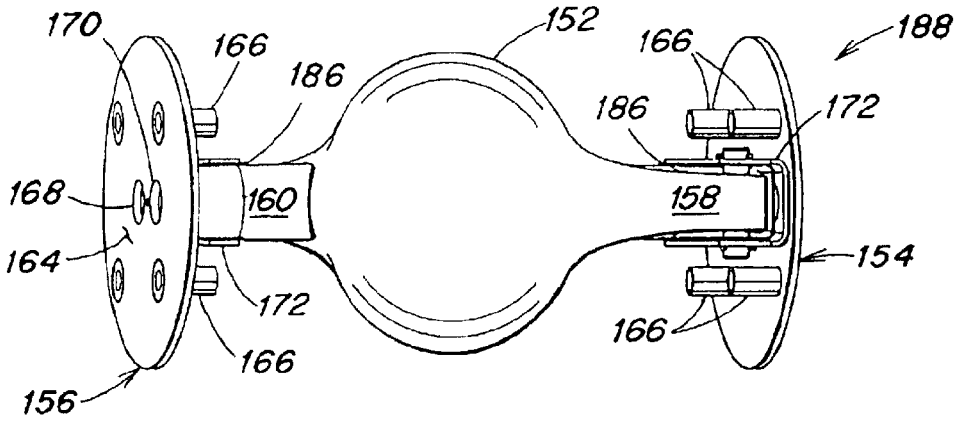
FIG. 15 is a top view of the depleted uranium shield and endplates of FIG. 14.
Figure 16:
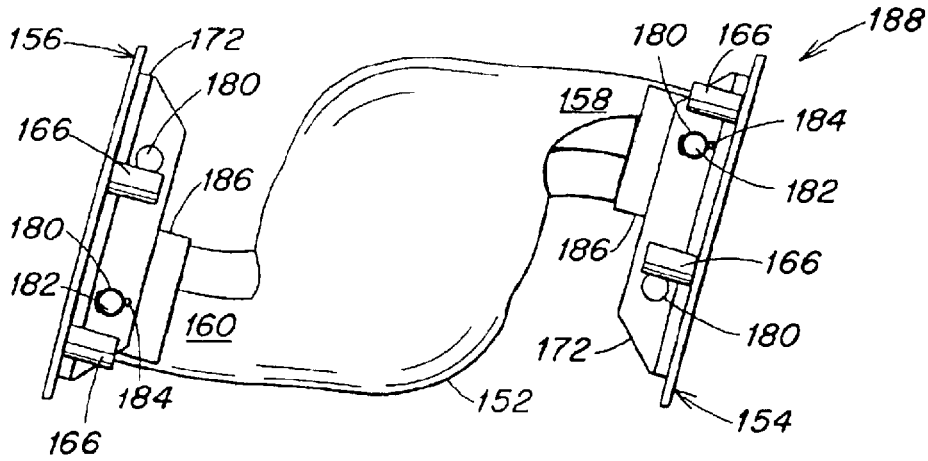
FIG. 16 is a side view of the depleted uranium shield and endplates of FIG. 14.

Referring now to FIGS. 14–16, a shield 152 of the illustrated embodiment of the radiographic camera 100 is shown attached to first and second endplates 154 and 156. As is known in the art, the shield 152 is depleted uranium, containing an S-shaped titanium conduit 116 cast into the shield 152, where the titanium conduit 116 includes the source 112 provided on an end of a source wire 114.

However, the source 112 could be provided within a shield 152 in any suitable manner. As shown in FIGS. 14–16, in the illustrated embodiment the shield 152 is connected to the endplates 154 and 156. By attaching the shield 152 directly to the housing 102, shearing of the conduit 116 may be prevented and a more secure attachment may be provided. The first and second shield ends 158 and 160 are secured to the endplates 154 and 156.

Figure 17:
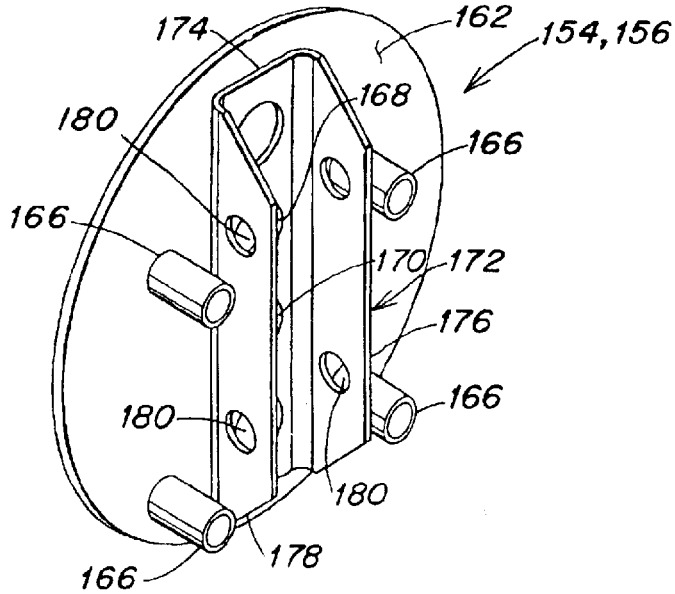
FIG. 17 is a perspective view of an endplate according to an embodiment of the invention.

Referring to FIG. 17, an endplate is shown. As illustrated, the endplate 154 and 156 is round for accommodation in the opening of the housing. The endplate 154 and 156 features a first and second surface 162 and 164. Four rivnuts 166 may be provided extending from the first surface 162. They are used to mount the lock assembly 108 or connector assembly 110 onto the endplates 154 and 156 with screws 167 (see FIGS. 19 and 21). The screws may be security tamper proof screws that require a special tool to remove. Additionally, the endplates 154 and 156 may be provided with first and second outlets 168 and 170, the first outlet 168 may be used for filling the housing 102 with foam after the shield 152 having the endplates 154 and 156 is inserted into the housing, and the second outlet 170 may be used for insertion of the conduit 116 containing the oil source wire 114.

Figure 18:
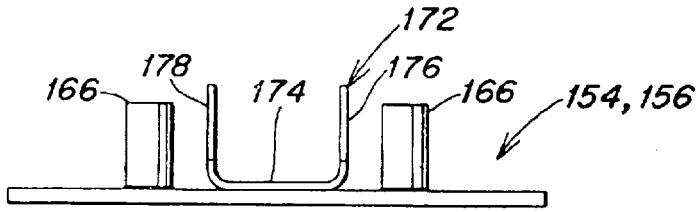
FIG. 18 is a top view of the endplate of FIG. 17.

A bracket 172 may be provided on the first surface 162 of the endplate. The bracket 172 is welded to the endplate 154 and 156, although the bracket 172 could be secured to the endplate 152 and 156 by any means, including by an adhesive or by molding or machining the bracket 172 into the endplates 154 and 156. Referring to the illustrated embodiment in FIG. 18, the bracket 172 includes a flat back piece 174 and two parallel extending flanges 176 and 178. The flanges 176 and 178 each have two holes 180, one hole 180 on each flange 176 and 178 is used to secure the shield end 158 and 160 to the bracket. In the illustrated embodiment, the other hole 180 is placed for symmetry in case the bracket 172 is mounted upside down on the endplate 154 and 156, but is not required. Referring to FIGS. 14–16, the first and second shield ends 158 and 160 are attached to the bracket 172 using a pin 182. Cotter pins 184 may be provided in the ends of each pin 182 to additionally secure the shield 152 to the endplate 154 and 156. The endplate 154 and 156 and the bracket 172 are made of stainless steel, although they could be made of any suitable metal or other material. As illustrated, an additional spacer 186 may be provided between the bracket 172 and the shield 152. The spacer 186 is made of copper. The spacer 186 could be made of other suitable metals or other materials, and preferably the spacer 186 is not made of steel. The spacer 186 may assist in preventing the occurrence of a possible reaction between the stainless steel and the depleted uranium that could weaken the steel. The reaction typically can occur at higher temperatures. Although brackets 172 are used in the illustrative embodiment to attach the shield ends 158 and 160 may be attached to the endplates 154 and 156 using any suitable structure(s), such as a ring-shaped collar that is attached to the endplates 154 and 156 and into which the shield ends 158 and 160 are inserted and secured, and so on.

Once the endplates 154 and 156 are attached to the shield 152, then the shield assembly 188 can be inserted within the housing 102 as illustrated in FIGS. 1–5. The construction of the shield assembly 188 may give the shield assembly 188 some flexibility, which assists in inserting the shield assembly 188 into the housing 102. The endplates 154 and 156 may be secured to the housing 102 by welding around their periphery or any other suitable manner. As in the embodiment illustrated in FIG. 2, after the endplates 154 and 156 are welded to the housing 102, an expandable foam 190 is inserted into the first outlets 168 in the endplates 154 and 156 to fill at least some of the remaining space inside the housing 102, after which the first outlets 168 are then sealed.

The foam 190 may be a polyurethane foam or any other suitable material.

Figure 19A:
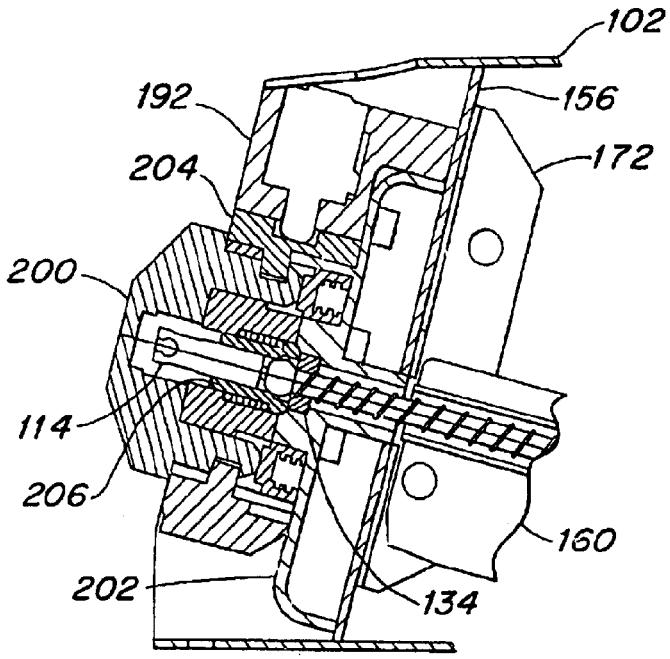
FIG. 19A is a cross-sectional view taken along line 19A—19A in FIG. 19.

The locking assembly 108 provided on the second endplate 156 is similar to the locking assembly described in U.S. Pat. No. 5,065,033 with differences that are discussed below. Referring to the illustrated embodiment in FIG. 19, a lock mount 192 is provided above the lock cover 194 that has two holes 196 and 198. The holes 196 and 198 are provided to accommodate pins (not shown) of a cap 200 on the lock cover 194. When the cap 200 is removed, the cap 200 can be stored safely and out of the way by inserting the pins of the cap 200 into the holes 196 and 198 of the lock mount 192. The holes 196 and 198 may have rubber sleeves that grip the pins of the cap 200 to additionally secure the cap 200 to the lock mount 192. The lock mount 192 and lock cover 194 are provided on a rear plate 202, and a selector ring 204 with the lock slide 134 are located between the rear plate 202 and the lock cover 194. Additionally, referring to FIG. 19A, the sleeve 206 inside the lock assembly 108 may be made of tungsten to further protect the user from possible radiation exposure from the source 112.

Figure 20:
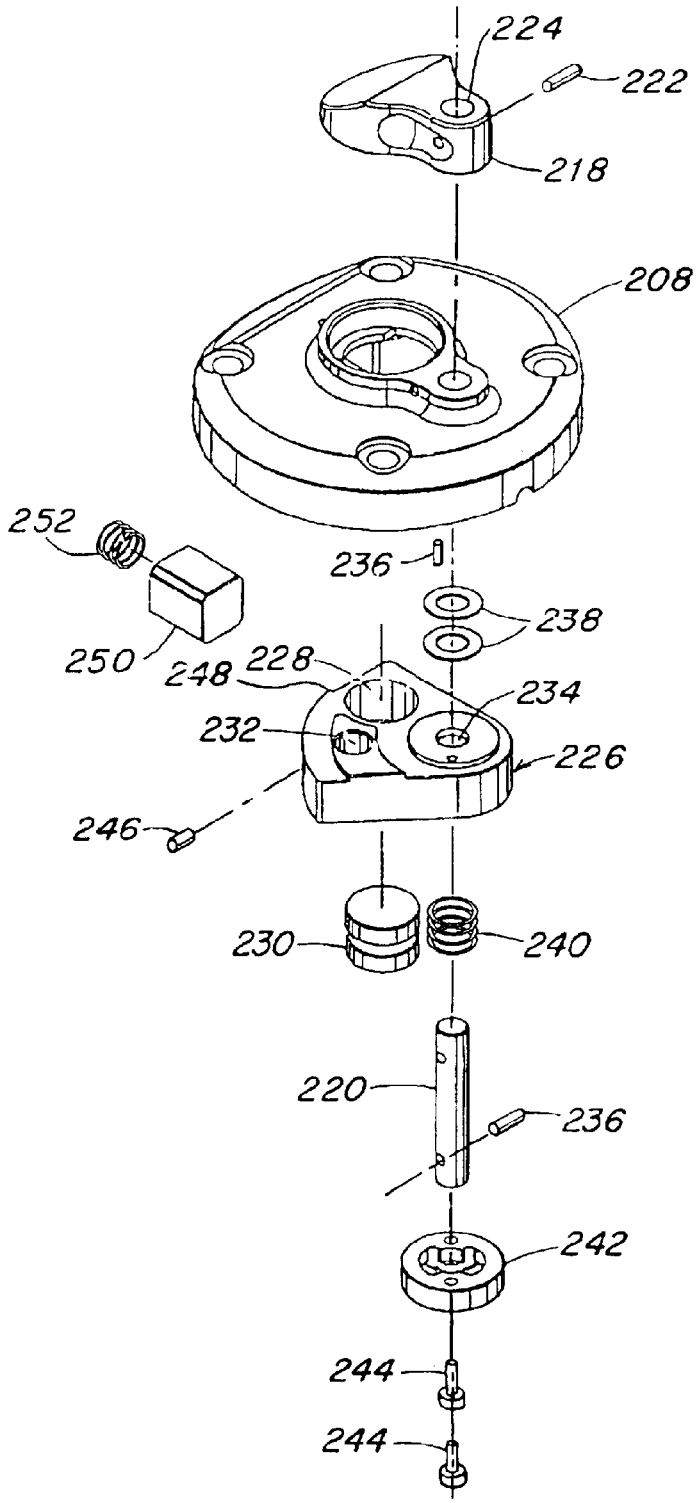
FIG. 20 is an exploded perspective view of the connector assembly according to an embodiment of the invention.

Referring to the illustrated embodiment of the invention in FIG. 20, an exploded view of the connector assembly 110 provided on the first endplate 154 of the camera 100 is shown. In this illustrative embodiment of the invention, the connector assembly 110 includes a shield protector that blocks an opening of the camera 100 through which the radiation source may move, e.g., to image an object. The shield protector may be normally locked in place to cover the opening and unlocked so that the shield protector may be moved to unblock the opening. The shield protector may be unlocked for movement by activation of a key associated with a guide cable that is attached to the connector assembly 110. For example, a fitting that is attached to an end of the guide cable may act as a key so that when the fitting is engaged with the connector assembly 110, the shield protector is unlocked for movement. Thus, in this illustrative embodiment, the shield protector may only be unlocked and moved to allow the radiation source to move into the guide cable when the guide cable is attached to the connector assembly 110. This may provide a safety feature whereby radiation from a source in the camera 100 may only be released when a key, e.g., a key associated with guide cable, is activated. Although in this illustrative embodiment, the guide cable fitting acts as a key, other elements attached to the guide cable or otherwise associated with the guide cable or other components needed for operation of the camera 100 may act as a key to unlock the shield protector. For example, a key attached by a wire to the guide cable end may be arranged so that the key (which may look and operate like a conventional lock key) may only be used to unlock the shield protector when the guide cable is attached to the connector assembly 10.

Figure 24:
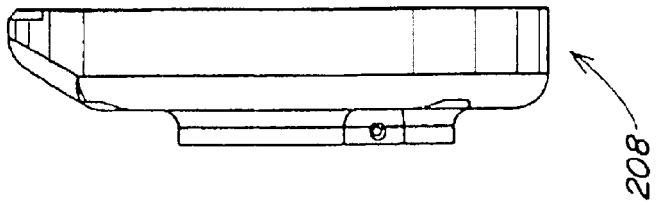
FIG. 24 is a side view of the front plate of the connector assembly of the present invention.
Figure 23:
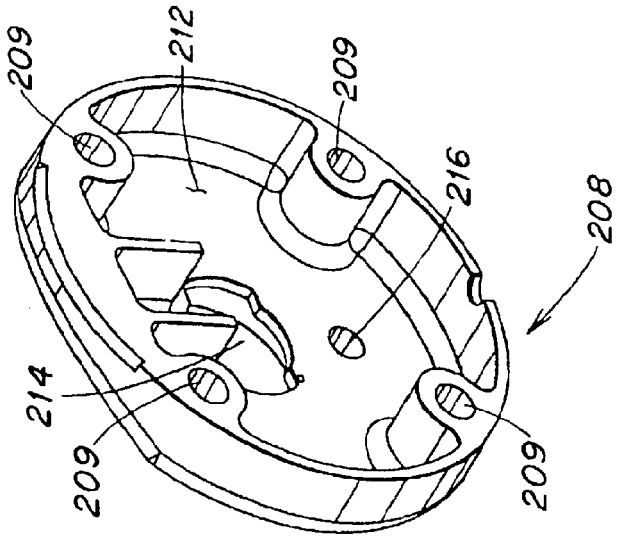
FIG. 23 is a perspective view of the back side of the front plate of the connector assembly according to an embodiment of the invention.
Figure 22:
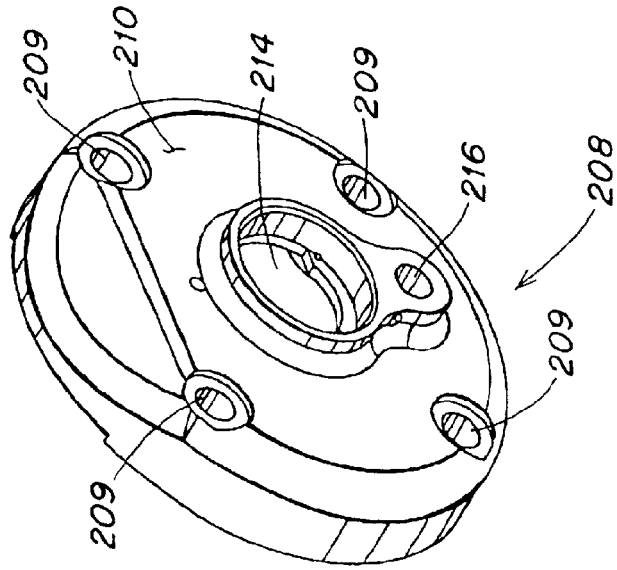
FIG. 22 is a perspective view of the front side of the front plate of the connector assembly according to an embodiment of the invention.

In this illustrative embodiment, the connector assembly 110 includes a front plate 208 connected to the first endplate 154. Screws 167 may be used to connect the front plate to the endplate, or any other suitable means such as welding. The screws 167 may be tamper proof, such that a special tool is needed to remove the front plate 208 from the endplate 154. The screws 167 are inserted into screw holes 209 in the front plate 208 and the rivnuts 166 on the endplate 154. As shown in FIGS. 22–24, the front plate 208 has an external surface 210 and an internal surface 212. The front plate 208 includes an first opening 214 and a second opening 216. The first opening 214 is aligned with the second outlet or port outlet 170 in the endplate 154.

Figure 21A:
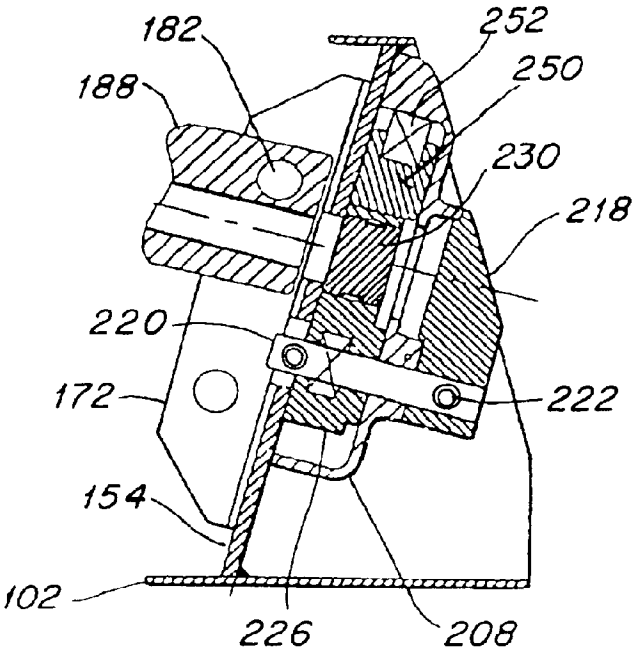
FIG. 21A is a cross-sectional view taken along line 21A—21A of FIG. 21.
Figure 21:
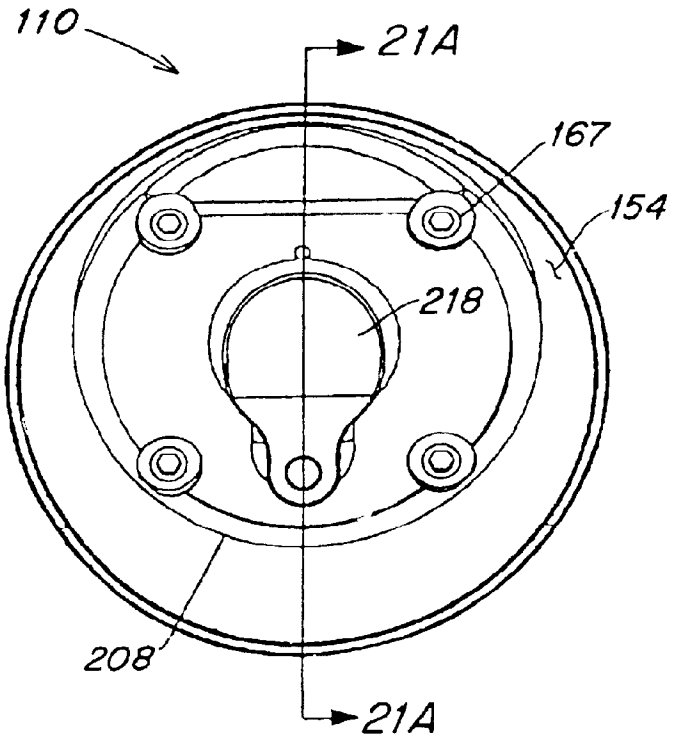
FIG. 21 is a front view of the connector assembly of FIG. 20.

Referring to the embodiment illustrated in FIGS. 20–21A, the external surface 210 may be provided with a knob 218 rotatably mounted on the front plate 208 by a shaft 220 and a roll pin 222. The knob 218 includes a knob hole 224 that receives the shaft 220, as does second opening 216, to rotatably secure the knob 218 to the front plate 208. The knob 218 is rotatably positioned to cover and uncover the first opening 214 in the front plate 208. For example, rotating the knob 218 90° may fully expose the first opening 214, but not rotate a shield protector and uncover the port outlet 170.

Figure 27:
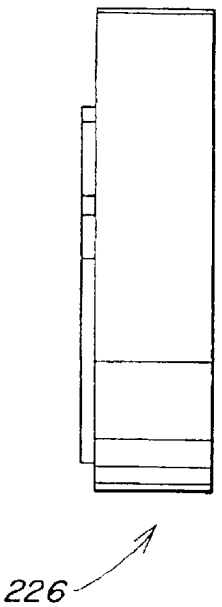
FIG. 27 is a side view of the rotor of FIG. 25.
Figure 26:
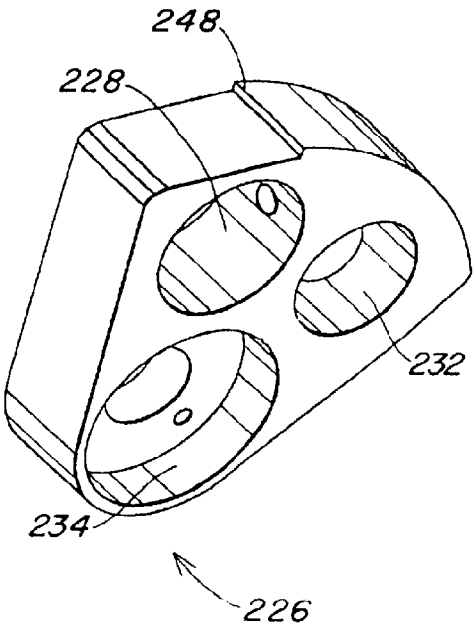
FIG. 26 is a perspective view of the back side of the rotor of FIG. 25.
Figure 25:
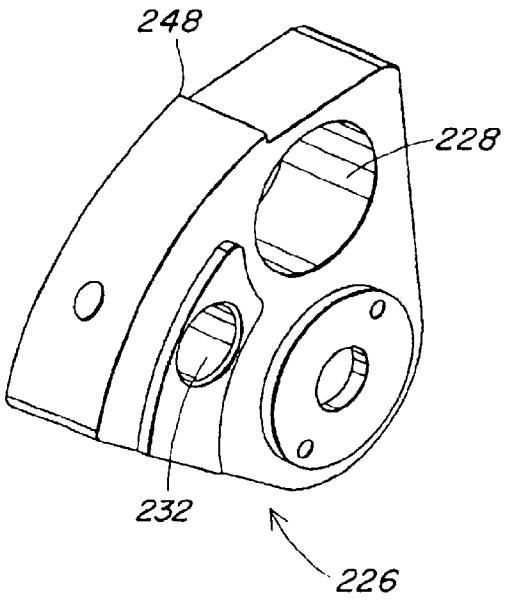
FIG. 25 is a perspective view of the front side of the rotor of the connector assembly according to an embodiment of the invention.

According to an illustrative embodiment of the invention, a shield protector 226 selectively blocks and unblocks the port outlet 170 to assist in preventing radiation exposure through the port outlet 170. The first opening 214 is adapted to receive a fitting 254 (see FIGS. 28–30) connected to the guide cable that allows the shield protector 226 to unblock the port outlet 170 and expose the source 112. When the fitting 254 is engaged at the first opening 214, the shield protector 226 is unlocked and may be moved to unblock the port outlet 170. Referring to the illustrated embodiment in FIGS. 20 and 25, on the internal surface 212 of the front plate 208 the shield protector 226 is a rotor 226 that is rotatably secured to the front plate 208. As seen more clearly in FIGS. 25–27, a first rotor hole 228 is provided on the rotor 226 and has a port shield 230 secured within the hole 228. The first rotor hole 228 and port shield 230 may be aligned with the port outlet 170 and the first opening 214 in the front plate 208. Thus, when the first rotor hole 228 is aligned with the port outlet 170, the port shield 230 covers access to the port outlet 170 through the first opening 214 and may help prevent radiation from escaping through the port outlet 170. The port shield 230 is made of tungsten, although any suitable material could be used. The rotor 226 includes a second rotor hole 232 adapted to align with the port outlet 170 upon rotation of the rotor 226. When the second rotor hole 232 is aligned with the port outlet 170, the radiation source may pass through the port outlet 170 into a guide cable.

The rotor 226 has a third rotor hole 234 which receives the shaft 220 to rotatably secure the rotor 226 to the front plate 208 using roll pins 236, washers 238, a first compression spring 240, a pivot disk 242, and socket head cap screws 244, and set screw 246 (shown in FIG. 20). The first compression spring 240 is held in place by a roll pin 236 and provides constant tension when the knob 218 is pulled which allows the knob 218 to be turned a first amount, for example 90°, without turning the rotor 226 to expose the first opening 214. The first compression spring 240 also assists in urging the rotor 226 toward the outside of the connector assembly 110. When the rotor 226 is unlocked, the knob 218 can be rotated an additional amount, for example 50°, to rotate the rotor 226 and align the second rotor hole 232 with the port outlet 170 and the first opening 214.

Figure 28:
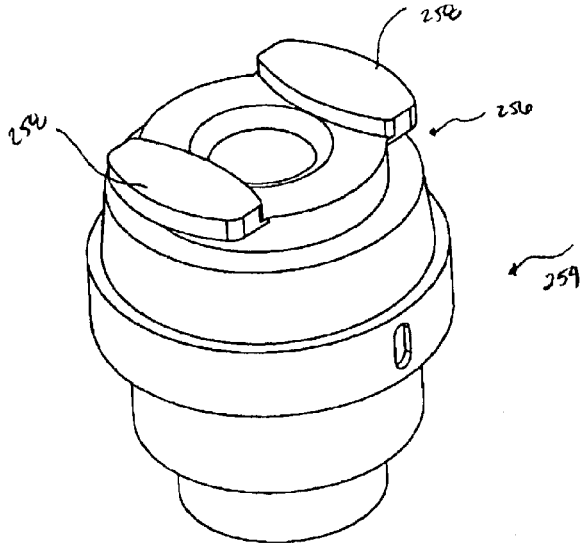
FIG. 28 is a perspective view of a tube fitting of a cable guide according to an embodiment of the invention.
Figure 29:
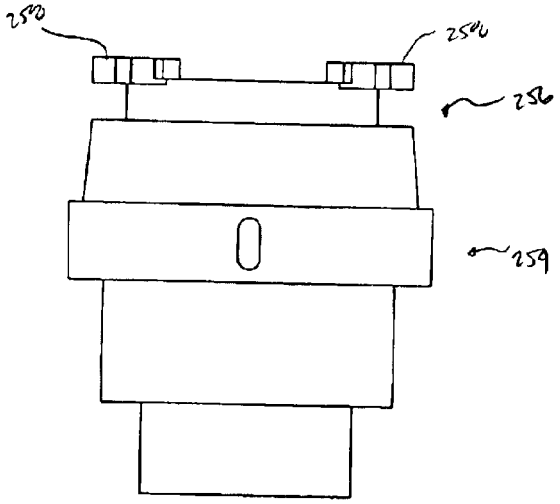
FIG. 29 is a side view of the tube fitting of the cable guide of FIG. 28.
Figure 30:
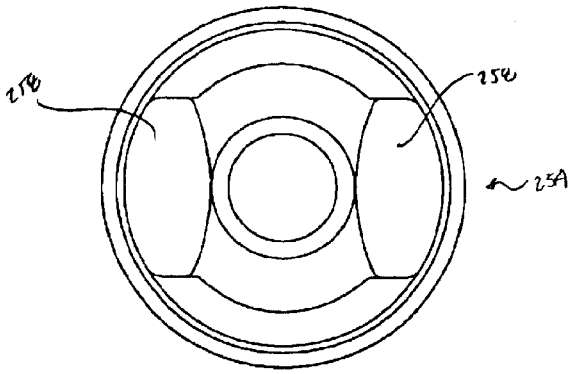
FIG. 30 is a top view of the tube fitting of the cable guide of FIG. 28.

In the illustrated embodiment, the rotor 226 features a flange 248, upon which rests a slider 250 and a second compression spring 252. The slider 250, which acts as a lock for the rotor 226, may prevent the rotor 226 from rotating. When the slider 250 is moved, the rotor 226 is allowed to rotate and align the second rotor hole 232 with the port outlet 170. A tube fitting 254, as shown in FIGS. 28–30, provided on the guide cable (not shown) may move the slider 250 when the fitting 254 is engaged with the first opening 214. In the illustrated embodiment, the top 256 of the tube fitting 254 can be inserted into the first opening 214 of the front plate 208. The tube fitting 254 may have at least one ear 258, or other suitable feature(s), which, when the tube fitting is rotated, moves the slider 250 to unlock the rotor 226 and to allow the rotor 226 to rotate.

The use of a shield protector 226 to uncover the port outlet 170 upon insertion of the tube fitting 254 provides additional protection to the user from radiation exposure.

Figure 31A:
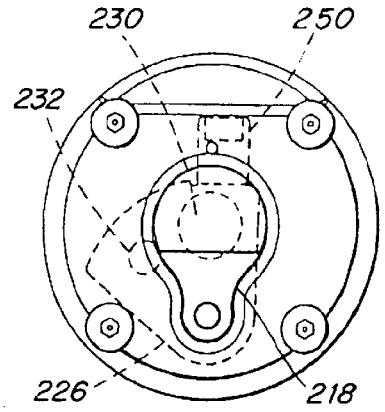
FIGS. 31A–D are front views of the connector assembly of an embodiment of the invention in various positions.
Figure 31B:
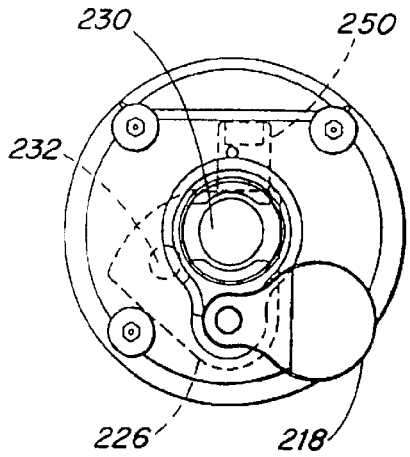
Figure 31C:
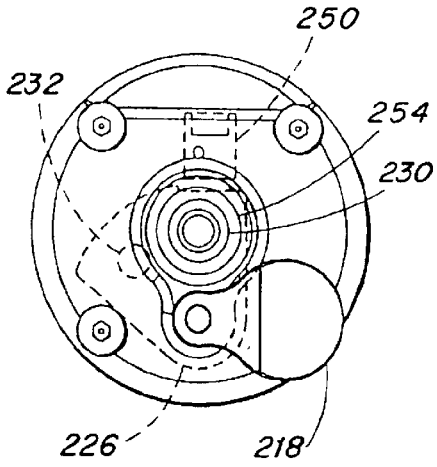
Figure 31D:
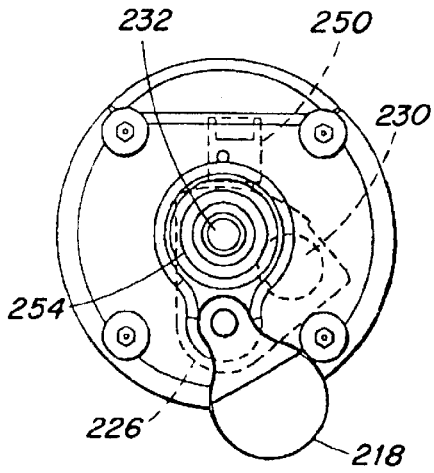

The various locations of the rotor 226 and knob 218 of the illustrated embodiment of the invention are shown in FIGS. 31A–D. For example, in FIG. 31A, the shipping position is shown where the port outlet 170 is covered and shielded by the port shield 230 and the knob 218. FIG. 31B shows the locked position where the knob 218 is lifted and rotated, e.g., 90°, to expose the first opening 214, but the port outlet 170 is still shielded by the port shield 230 in the first rotor hole 228. Referring to FIG. 31C, the connect position is shown, the tube fitting 254 is inserted into the first opening 214 and rotated to move the slider 250 and unlock the rotor 226. The port outlet 170 is still shielded. FIG. 31D shows the exposed position where the knob 218 is rotated, e.g., 50°, and turns the rotor 226 such that the second rotor hole 232 is aligned with the port outlet 170, thus exposing the port outlet 170 through the second rotor hole 232 and the first opening 214 in the front plate 208.

Although the present invention is described with reference to certain preferred embodiments, it will be appreciated that numerous modifications and other embodiments may be devised by those skilled in the art. For example, the connector assembly may be provided without a knob, and another mechanism may be used for rotating the rotor, e.g., engagement of a fitting on the guide cable with the connector assembly and/or operation of another type of key may operate to both unlock and rotate the rotor to expose the port outlet. In addition, the element that blocks and unblocks the port outlet (the rotor 226 in the embodiment described above) need not move in a rotary fashion, but instead may slide linearly or in any other suitable way. A lock may also be provided to prevent disengagement of the guide cable from the camera unless the port outlet is blocked. Therefore, it will be understood that the appended claims are intended to cover all such modifications and embodiments which come within the spirit and scope of the present invention.

What is claimed is:

1. A radiographic camera, comprising:

a camera having a body suitable for use in a pipeline:

a jacket having a front end of the jacket and a back end opposite the front end; and a handle positioned between the front and back ends of the jacket, the handle constructed and arranged to carry the camera;

wherein the jacket is adapted to be removably secured to the camera and the camera is functional with and without the jacket.

2. The camera of claim 1 wherein the jacket includes molded polyurethane.

3. The camera of claim 1 wherein the jacket defines an opening to receive the radiographic camera, that extends through the front end of the jacket to the backend of the jacket.

4. A radiographic camera, comprising:

a housing containing a radioactive source in a pathway surrounded by a radiation shield;

a first end of the housing, having a first opening at a first endplate in communication with the pathway;

a second end of the housing, having a second opening in communication with the pathway, the second opening having a lock assembly;

a radiation shield protector at the first end of the housing adapted to selectively block and unblock the first opening; and a front plate adjacent the radiation shield protector, the radiation shield protector provided between the first endplate and the front plate, the front plate having a hole aligned with the first opening and adapted to receive a guide cable fitting that allows the radiation shield protector to unblock the first opening and expose the radioactive source, wherein the lock assembly functions independently of the radiation shield protector and guide cable fitting.

5. The connector assembly of claim 4, wherein the shield protector is a rotor rotatably attached to an interior surface of the front plate between the front plate and the first endplate, the rotor including a first rotor hole formed in the rotor locating a port shield to be aligned with the first opening, and a second rotor hole adapted to be aligned with the first opening upon rotation of the rotor.

6. The connector assembly of claim 5 further comprising a slider adjacent the rotor that prevents rotation of the rotor, wherein the front plate hole is adapted to receive the guide cable fitting to move the slider to allow the rotor to rotate and expose the first opening through the second rotor hole.

7. The connector assembly of claim 6 further comprising a knob rotatably attached to an exterior surface of the front plate and positioned to cover and uncover the front plate hole, wherein the knob is rotatable to expose the front plate hole such that the guide cable fitting is insertable within the front plate hole to move the slider, and the knob is thereby further rotatable to cause the rotor to rotate to align the second rotor hole with the first opening and the front plate hole to expose the source.

8. The connector assembly of claim 5 wherein the port shield is tungsten.

9. A radiographic camera apparatus, the apparatus comprising:

a housing having an interior chamber, a first opening and a second opening formed by the housing, the first opening opposite the second opening on the housing;

a lock assembly in communication with the housing at the first opening;

a front plate having an interior and an exterior surface and defining a hole, the front plate in communication with the housing at the second opening to align the hole with the second opening;

a conduit within the housing containing a radiation source and in communication with the lock assembly at one end and the front plate at the other end, a pathway being formed by the conduit to an exterior of the housing through the front plate; and a rotor rotatably attached to the interior surface of the front plate, the rotor defining a first rotor hole aligned with the second opening and having a radiation shield therein, and the rotor defining a second rotor hole for alignment with the second opening upon rotation of the rotor, wherein the rotor is locked in position with the radiation shield aligned with the second opening and is adapted to be unlockable when a fitting is engaged in the hole of the front plate and wherein the front plate does not include a removable plug for insertion in the hole when in a storage condition.

10. The apparatus of claim 9 further comprising a knob rotatably attached to the exterior surface of the front plate and positioned to rotatably cover and uncover the hole of the front plate, wherein the knob is rotatable to expose the hole in the front plate and the shield in the first rotor hole, and the knob is further rotatable to cause the rotor to rotate to align the second rotor hole with the second opening when the rotor is unlocked.

11. The connector assembly of claim 9 further comprising a slider adjacent the rotor that prevents rotation of the rotor, wherein when the slider is caused to move the rotor is allowed to rotate and expose the second opening through the second rotor hole.

12. The connector assembly of claim 11 wherein upon insertion of the fitting into the hole of the front plate, the fitting is rotated and causes the slider to move, thereby allowing the rotor to rotate and expose the second opening through the second rotor hole.

13. The connector assembly of claim 12 further comprising at least one ear on the fitting, wherein the ear fits within the hole and upon rotation of the fitting interacts with and moves the slider to allow rotation of the rotor to occur.

14. A connector assembly for a radiographic camera, comprising:

a connection element adapted to engage with a guide cable, the connection element including an opening aligned with a radiation source opening in the camera through which a radiation source can pass;

a radiation shield protector provided with the connection element, the radiation shield protector movable between blocking and unblocking positions, where in the blocking position the radiation shield protector blocks the radiation source opening and in the unblocking position the radiation shield protector does not block the radiation source opening; and a lock that is adapted to lock the radiation shield protector in the blocking position and is adapted to unlock the radiation shield protector upon activation of a key located outside the camera at the connection element end of the camera to allow the radiation shield protector to move to the unblocking position, wherein the radiation source cannot move through the radiation source opening until the radiation shield protector is moved to the unblocking position and wherein position of the radiation shield protector is independent of operation of a lock assembly.

15. The connector assembly of claim 14, wherein:

the shield protector comprises a rotor that may rotate to block and unblock the radiation source opening, and the lock comprises a slider that is adapted to engage with the key to unlock the rotor from the blocking position.

16. The connector assembly of claim 15, further comprising: a knob adapted to move the rotor to unblock the radiation source opening upon engagement of the slider with the key.

17. The connector assembly of claim 14, wherein the lock is adapted to engage with a guide cable fitting that acts as the key.

18. The connector assembly of claim 17, wherein the lock comprises a slider that unlocks the shield protector from the blocking position when the guide cable fitting is secured to the opening in the connection element.

19. A method of operating a radiation camera, comprising:

releasing a radiation shield protector that blocks a radiation source opening at a connector assembly in the camera by attaching a guide cable fitting to the connector assembly;

moving the radiation shield protector to unblock the radiation source opening by activating a mechanism outside a housing of the camera at the connector assembly end; and moving a radiation source from within the camera through the radiation source opening, wherein the steps of releasing and moving the radiation shield protector are independent of operation of a lock assembly on the camera.

20. The method of claim 19, wherein the mechanism is incorporated into the guide cable fitting.

21. The method of claim 19, wherein the step of releasing the shield protector comprises engaging the guide cable fitting with a slider.

22. The method of claim 19, wherein the step of moving the shield protector comprises rotating a knob attached to the shield protector to align a hole in the shield protector with the radiation source opening wherein the radiation source is thereafter movable through the radiation source opening.

* * * * *